US010791829B1

(12) United States Patent
Carmichael

(10) Patent No.: US 10,791,829 B1
(45) Date of Patent: Oct. 6, 2020

(54) VERTICALLY-SLIDING MOUNT

(71) Applicant: Richard C. Carmichael, Georgetown, TX (US)

(72) Inventor: Richard C. Carmichael, Georgetown, TX (US)

( * ) Notice: Subject to any disclaimer, the term of this patent is extended or adjusted under 35 U.S.C. 154(b) by 0 days.

(21) Appl. No.: 15/965,431

(22) Filed: Apr. 27, 2018

Related U.S. Application Data

(60) Provisional application No. 62/512,963, filed on May 31, 2017.

(51) Int. Cl.
*A47B 67/02* (2006.01)

(52) U.S. Cl.
CPC ..... *A47B 67/02* (2013.01); *E05Y 2600/314* (2013.01)

(58) Field of Classification Search
CPC ... A47B 67/02; A47B 51/00; E05Y 2600/314; A47G 1/1613; A47G 1/1633; A47G 1/164; E06B 3/4423; E06B 3/443; E06B 3/4663; E06B 9/01; E06B 9/02; E06B 9/04; E06B 2009/002; Y10T 16/64; Y10T 16/641
USPC ..... 312/139.2, 360, 321.5, 242, 312; 248/295.11, 297.11, 330.1, 244, 246; 49/449, 360, 362, 363, 372, 374
See application file for complete search history.

(56) References Cited

U.S. PATENT DOCUMENTS 1,898,584 A * 2/1933 Mantz ..... E05D 13/1292 16/198
1,905,107 A * 4/1933 Kersting ..... E05D 13/1276 16/198
2,120,327 A * 6/1938 Elsaesser ..... F25D 23/021 312/296
2,466,848 A 4/1949 Hausner
2,773,728 A 12/1956 La Barre
3,018,690 A 1/1962 Magrauth
3,358,403 A * 12/1967 Dinsmore ..... E05D 13/1207 49/445
3,489,480 A * 1/1970 Slouka ..... A61G 15/14 312/312
3,640,596 A * 2/1972 Kanitz ..... A47B 63/067 312/306
3,652,048 A 3/1972 Hartman
4,895,336 A * 1/1990 Lieberman ..... B25H 3/006 248/328
4,935,987 A * 6/1990 Sterner, Jr. ..... E05D 13/1276 16/197
5,448,859 A 9/1995 Walker et al.
5,924,780 A * 7/1999 Ammon ..... G06F 1/181 312/223.2
6,471,311 B1 * 10/2002 Snyder ..... A47B 51/00 312/245
7,069,924 B2 * 7/2006 Kuttalek ..... F24C 15/027 126/273 R (Continued)

*Primary Examiner* — Jonathan Liu
*Assistant Examiner* — Guang H Guan
(74) *Attorney, Agent, or Firm* — Cramer Patent & Design, PLLC; Aaron R. Cramer

(57) ABSTRACT

A vertically sliding frame mounting system that includes a frame, frame mounted first and second bracket assemblies, wall mounted first and second brace assemblies having recoil springs and self releasing latches. The bracket assemblies slide in the brace assemblies which act as vertical guides while the recoil springs tend to lift the frame. The latch assemblies secure the frame in a lowered position while the recoil springs bias the frame upward.

14 Claims, 5 Drawing Sheets

(56) References Cited

U.S. PATENT DOCUMENTS

| | | | | |
|---|---|---|---|---|
| 7,121,042 | B2 * | 10/2006 | Robert | E05D 15/20 49/260 |
| 7,744,035 | B2 * | 6/2010 | Saint-Jalmes | B64D 11/003 244/118.5 |
| 7,775,000 | B2 | 8/2010 | Walker et al. | |
| 8,375,646 | B2 * | 2/2013 | Newkirk | A61G 12/00 49/213 |
| 8,955,260 | B2 * | 2/2015 | Newkirk | A61G 12/00 49/213 |
| 9,046,214 | B2 * | 6/2015 | Chang | F16M 11/046 |
| 9,675,172 | B2 * | 6/2017 | Pandorf | A47B 67/02 |
| 2010/0270438 | A1 | 10/2010 | Pandorf et al. | |
| 2012/0043865 | A1 | 2/2012 | Newkirk et al. | |

* cited by examiner

VERTICALLY-SLIDING MOUNT

The present invention is a U.S. Non-Provisional application Ser. No. 15/965,431 filed on Apr. 27, 2018, which was first described in, and claims the benefit of U.S. Provisional Application No. 62/512,963 filed May 31, 2017, the entire disclosures of which are incorporated herein by reference.

FIELD OF THE INVENTION

The present invention relates to wall storage compartments. More particularly, the present invention relates to vertically sliding frame mounting systems that conceal wall storage compartments.

BACKGROUND OF THE INVENTION

There are many circumstances under which recessed wall storage compartments can benefit from concealment. For example, concealing wall storage compartments such as safes, medicine cabinets, gun cabinets, electrical panels, and the like provide not only security but can increase safety. Pictures or mirrors are typically mounted on such frames that are then hung over wall storage compartments. By properly selecting the picture or mirror the benefits of concealing recessed wall-mounted compartments can include improved aesthetics.

However, when access to a concealed wall storage compartment is desired it can be cumbersome, hazardous, and time-consuming to remove the covering frame. In addition, frequent removal exposes the covering frame to damage as well as misalignments that can occur after reinstallation. Such damage and misalignments may give away the location of the concealed compartment and might seriously harm room aesthetics.

Accordingly, there exists a need for systems which can conceal recessed wall storage compartments in a manner which provides security and safety while enabling improved aesthetics. Beneficially such systems would enable quick and easy access to the storage compartment. Ideally such systems would be highly effective, would not be subject to frame to damage or misalignments, and could be made available at relatively low cost.

SUMMARY OF THE INVENTION

The principles of the present invention provide for systems which conceal wall storage compartments in a manner which provides security and safety while also enabling improved aesthetics. Beneficially such systems enable quick and easy access to the storage compartment while not subjecting the covering frame to damage or misalignments. In addition, the inventive systems are suitable for being made available at relatively low cost.

A vertically sliding frame mounting system that is in accord with the present invention includes a frame, first and a second bracket assemblies that are attached to the frame; a first brace assembly having a first recoil spring, the first brace assembly for being attached to a wall while the first recoil spring is for connecting to the first bracket assembly, a second brace assembly having a second recoil spring, the second brace assembly for being attached to a wall while the second recoil spring is for connecting to the second bracket assembly, a first self-releasing latch having a first latch receiver for attaching to a wall and a first latch insert attached to the first bracket assembly, and a second self-releasing latch having a second latch receiver for attaching to a wall and a second latch insert attached to the second bracket assembly. The first bracket assembly slides into the first brace assembly while the second bracket assembly slides into the second brace assembly. The first and second latch assemblies secure the frame in a lowered position while the first and the second recoil springs bias the frame upward.

Beneficially the frame can retain a mirror. In addition, the first recoil spring includes a first tension adjustment, a wound first cable, and a hook that connects the first coil to the first bracket assembly. In practice the first and second recoil springs together provide sufficient lift force to lift the first and second bracket assemblies and the frame. However, beneficially the first and second recoil springs are not strong enough to lift the first and second bracket assemblies and the frame away from the first and second self-releasing latches when those self-releasing latches are latched.

In practice the first bracket assembly is attached near the right side of the frame while the second bracket assembly is attached near the left side. Also, in practice the first bracket assembly and the second bracket assembly are identical. The first bracket assembly includes a first bracket slide and a first alignment rod. If so the first bracket slide can have a first upper tab that connects the first bracket assembly to the top of the frame. The first bracket slide may further include an alignment rod mount that attaches the bottom of the first alignment rod to the bottom of the frame. In many applications the first bracket slide extends below the midpoint between the top and the bottom of the frame.

In practice the first brace assembly and the second brace assembly are mirror images of one another. In any event the first brace assembly can include a first slide guide that receives the first slide bracket. If so the first slide guide should have top-flared openings. The first slide guide and the first recoil spring are beneficially integrally connected to form a one-piece structure. The first latch receiver might include a latch clip that engages with the first latch insert. The first latch insert might be cylindrical. In practice the first latch insert, the first bracket assembly, and the first brace assembly are aligned with the first latch receiver such that lowering the first bracket assembly causes the first latch insert to enter the first latch receiver.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
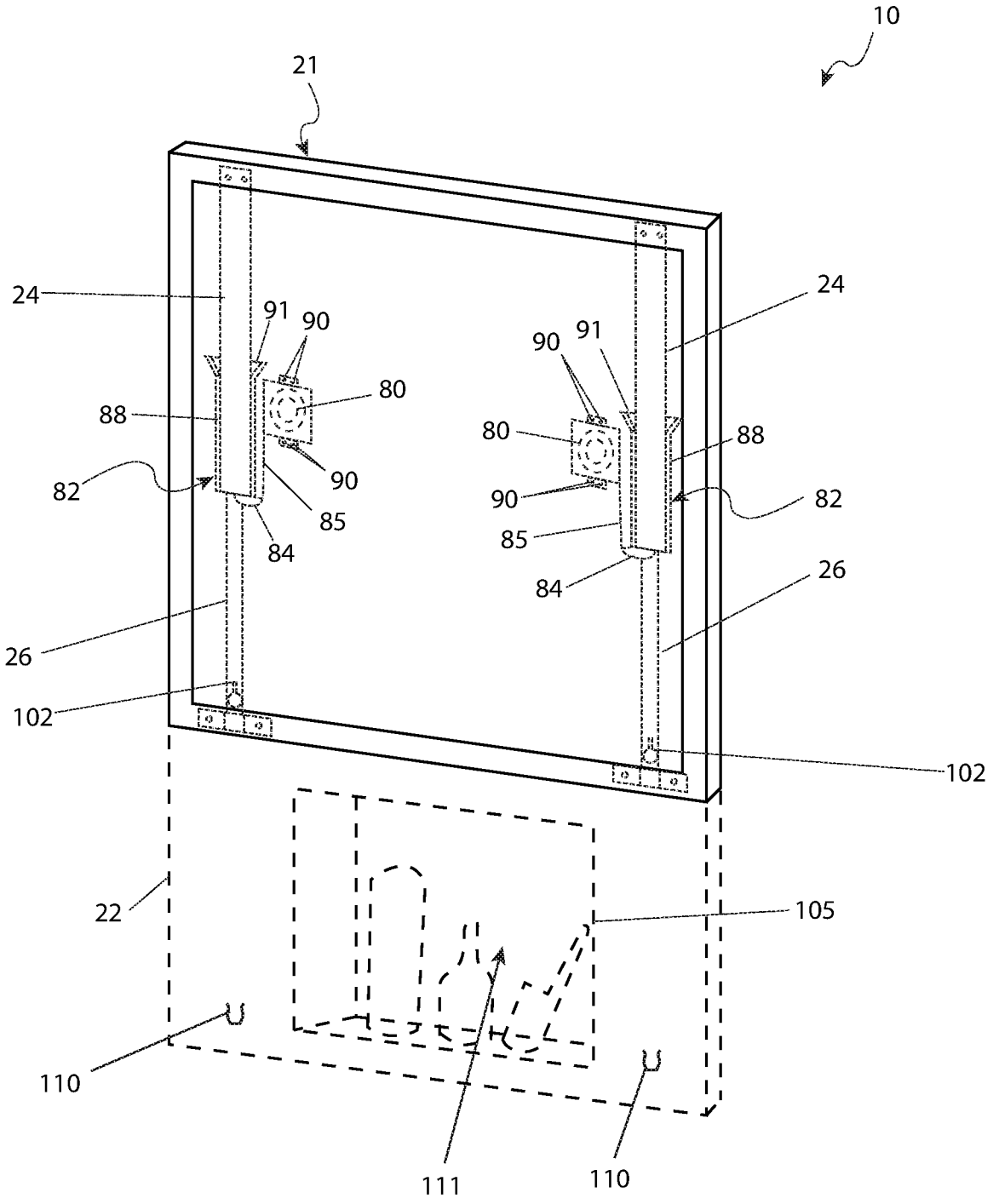
FIG. 1 is a front perspective view of a vertically sliding frame mounting system 10 that is in accord with the preferred embodiment of the present invention.

10 vertically sliding frame mounting system
20 bracket assembly
21 frame
22 lowered position
24 bracket slide
26 alignment rod
30 alignment rod mount
80 recoil spring
81 upper tab
82 brace assembly
84 hook
85 cable
88 slide guide
90 fastener
91 flared opening
100 wall
102 latch insert
105 recessed compartment
110 latch receiver
111 items

DETAILED DESCRIPTION OF THE PREFERRED EMBODIMENT

The preferred embodiment of the invention and its various elements are depicted in FIG. 1 through FIG. 6. However, the invention is not limited to the specifically described embodiment. A person skilled in the art will appreciate that many other embodiments of the invention are possible without deviating from the basic concept of the invention. Any such work around will also fall under the scope of this invention.

It should be understood that the terms "a" and "an" as used herein do not denote a limitation of quantity, but rather denote the presence of at least one (1) of the referenced items.

Referring now primarily to FIG. 1, the present invention is a vertically sliding frame mounting system 10 having two (2) bracket assemblies 20 (see FIG. 2) which share a common frame 21, two (2) brace assemblies 82 (best shown in FIG. 3) which include recoil springs 80, and two (2) self-releasing latches that are comprised of a latch receiver 110 and a latch insert 102. The frame 21 is a rigid structure that can hold a mirror, a painting, a poster, a decorative panel, or the like. When the vertically sliding frame mounting system 10 is at its lowered position 22 the frame 21 and what it holds can conceal a recessed compartment 105 that may contain items 111. The vertically sliding frame mounting system 10 is secured at its lowered position 22 via the self-releasing latches.

The recoil springs 80 are beneficially strong enough to lift the weight of the bracket assemblies 20 and the frame 21 (and what it holds) when the vertically sliding frame mounting system 10 not held in its lowered position 22 by the self-releasing latches. However, the recoil springs 80 are not strong enough to pull the vertically sliding frame mounting system 10 out of the self-releasing latches.

Figure 2:
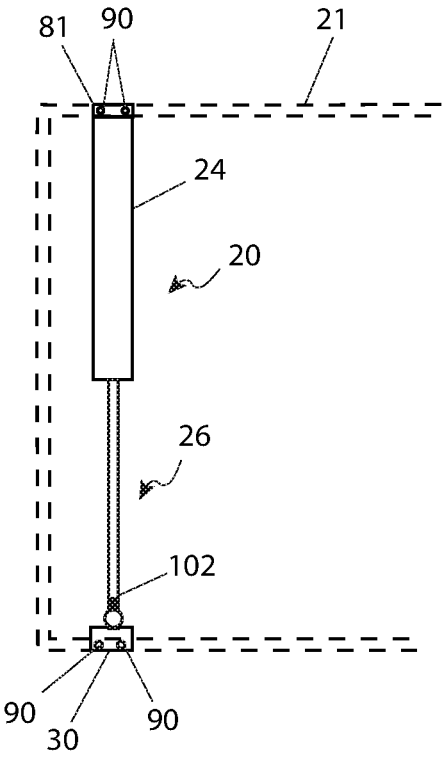
FIG. 2 is a partial frontal view of one (1) of two (2) bracket assemblies 20 of the vertically sliding frame mounting system 10 depicted raised.

FIG. 2 shows one (1) of the two (2) bracket assemblies 20 in more detail. The other bracket assembly 20 is identical to the one shown but is located on the right-hand side of the frame 21. Thus, each bracket assembly 20 is located near a vertical edge of the frame 21. As shown, the bracket assembly 20 includes a bracket slide 24 having an upper tab 81 and an alignment rod 26 that extends downward from the bracket slide 24. The distal end of the alignment rod 26 fits into an alignment rod mount 30. The upper tab 81 attaches the bracket slide 24 to the top of the frame 21 using fasteners 90. In a similar manner the alignment rod mount 30 attaches the alignment rod 26 to the frame 21 using fasteners 90.

It should be noted that each bracket slide 24 extends below the midpoint between the top and the bottom of the frame 21. The reason for that is explained subsequently.

Figure 3:
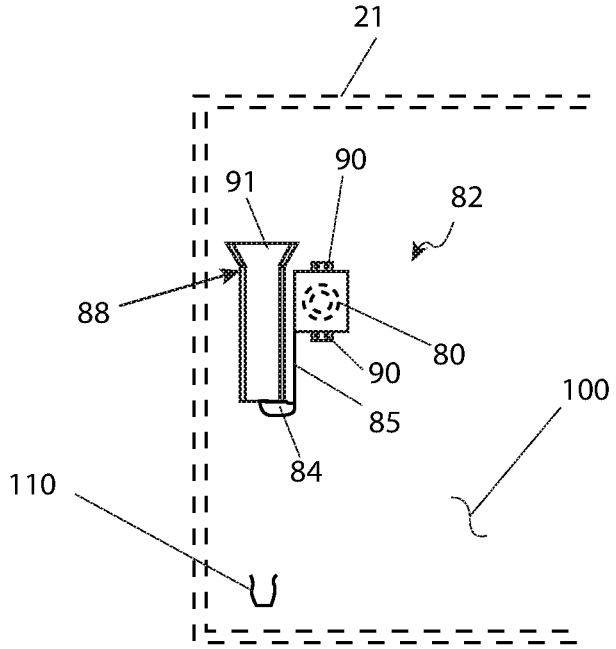
FIG. 3 is a front view of one (1) of two (2) brace assemblies 82 of the vertically sliding frame mounting system 10.

FIG. 3 shows one (1) of the two (2) braces assemblies 82 in more detail. The other brace assembly 82 is a mirror-image of the one (1) that is depicted. Each brace assembly 82 includes a slide guide 88, a recoil spring 80, a hook 84, and a cable 85. The braces assemblies 82 are attached to the wall using fasteners 90 such that the slide guides 88 are in vertical alignment with an associated bracket assembly 20 and a latch receiver 110.

Each slide guide 88 captures a bracket slide 24. To assist that capture the slide guides 88 include flared openings 91 at their top. The flared openings 91 reduce the difficulty of inserting a bracket slide into a slide guide 88. When the bracket slides 24 are captured in the slide guide 88 the motion of the frame 21 is restricted to the vertical direction. In addition, the top and bottom of the frame 21 are restricted to being horizontally level. Thus, any structure held by the frame 21 can only move vertically with its top and bottom level. In addition, when the frame 21 is lowered the latch inserts 102 are guided into the latch receivers 110.

Each recoil spring 80 is integrally connected with the remainder of its associated brace assembly 82 so as to form a one-piece structure. The recoil springs 80 are internally spring-loaded devices. Wound within each recoil spring 80 is a cable 85. Each cable 85 externally connects to a hook 84 that extends over the bottom of its associated slide guide 88. The recoil springs 80 include a user-adjustable tension mechanism that can compensate for differing frame 21 weights. Such user-adjustable tension mechanisms are well known and thus need not be described in detail.

It should be understood that together the recoil springs 80 exert an upward force that is sufficient to at least slightly overcome the combined weight of the frame 21, what the frame 21 holds, and the two (2) brace assemblies 82. This enables easy raising and lowering of the frame 21. However, the combined upward force of both recoil springs 80 is insufficient to overcome the combined weight of the frame 21, what the frame 21 holds, the two (2) brace assemblies 82, and the strengths of the self-releasing latches comprised of the latch inserts 102 and latch receivers 110. Thus, the need for the user-adjustable tension mechanisms to properly adjust the tensions of the recoil springs 80.

Figure 4:
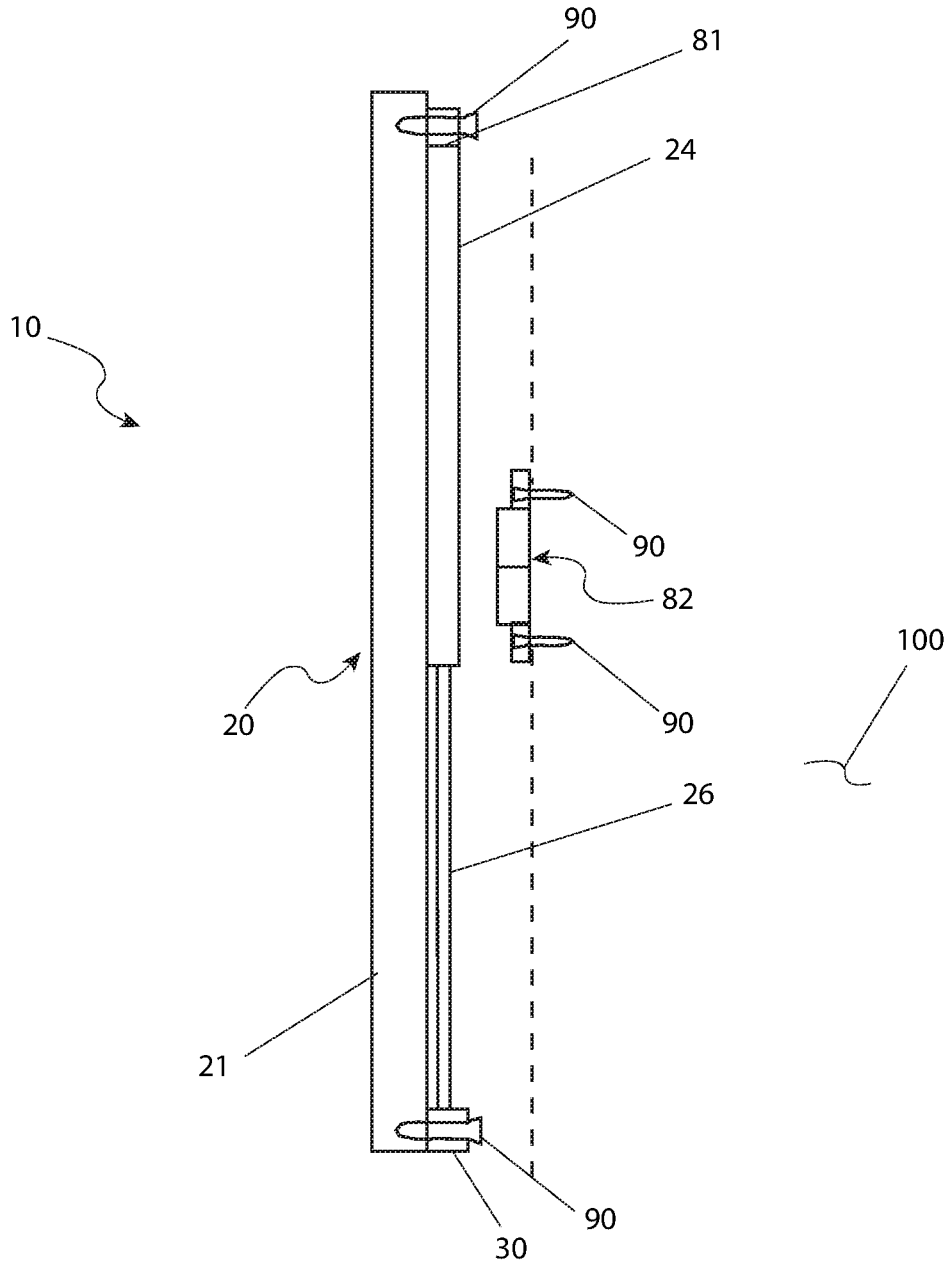
FIG. 4 depicts the relative orientations of a bracket assembly 20 and a brace assembly 82 of the vertically sliding frame mounting system 10.
Figure 5:
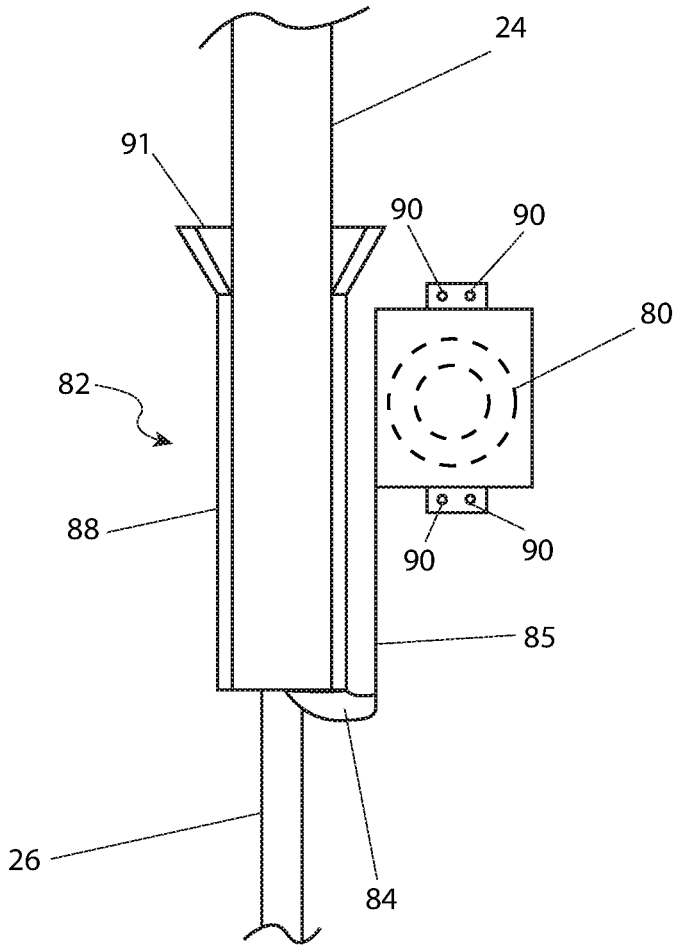
FIG. 5 depicts the operational relationship between a bracket assembly 20 and a brace assembly 82 of the vertically sliding frame mounting system 10; and, FIG. 6 depicts the latch receiver 110, the latch insert 102 and the components of the bracket assembly 20 of the vertically sliding frame mounting system 10.

FIG. 4 and FIG. 5 assist the understanding of the spatial relationships between the bracket assemblies 20 and the brace assemblies 82. As shown the bracket slide 24 and the alignment rod mount 30 are secured to the frame 21 via fasteners 90. The brace assemblies 82 are attached to the wall via fasteners 90. Each bracket slide 24 is captured by an associated slide guide 88. In addition, when each bracket slide 24 is inserted into its associated slide guide 88 an associated hook 84 that is attached to the cable 85 captures the end of the bracket slide 24. Thus, each recoil spring 80 applies an upward bias to its associated bracket assembly 20 once the bracket slides 24 are fully inserted.

As shown in FIG. 4 and as discussed previously the bottom of the bracket slide 24 is located more than half way below the top and bottom of the frame 21. That causes a continuous upward bias to be applied by the recoil spring 80 which prevents the hook 84 from coming free. Please note, the latch inserts 102 are not shown in FIG. 4.

Figure 6:
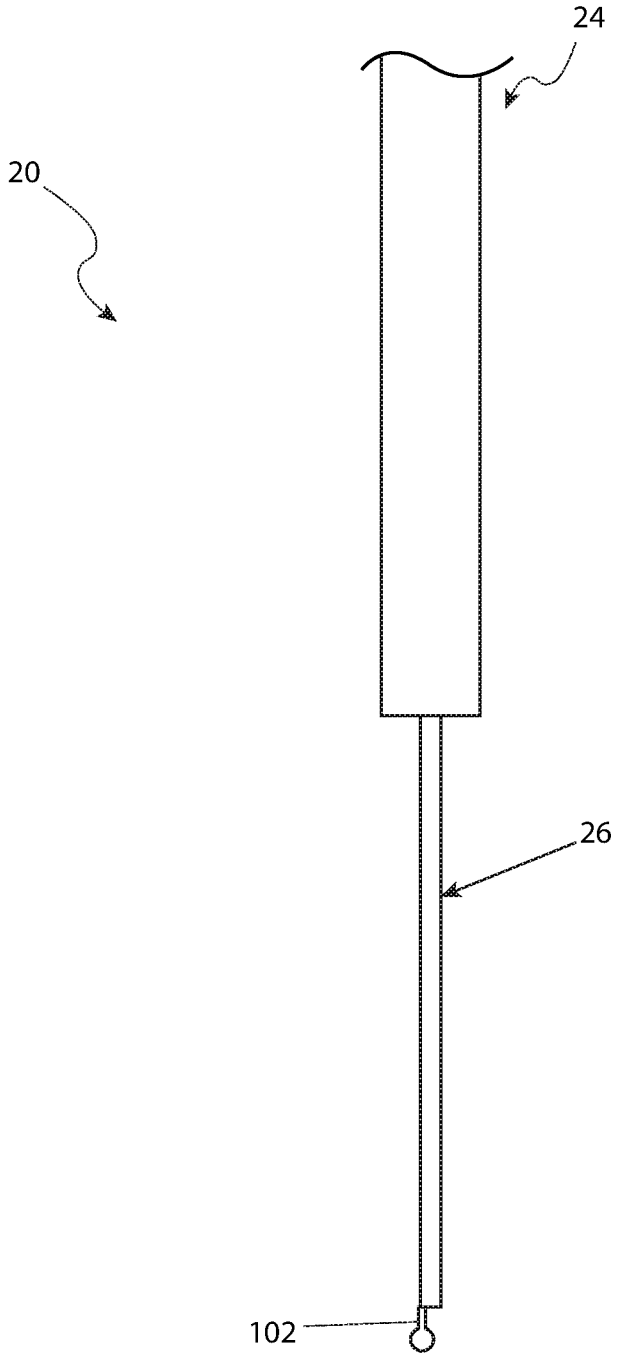

Referring now to FIG. 6, the latch receivers 110 are affixed to the wall 100 using fasteners 90. The latch receivers 110 implement "U"-shaped receiving clips. The latch inserts 102 are attached at or near the bottom of the alignment rods 26. In practice the latch inserts 102 are cylindrical so they can pull free of the latch receivers 110 given sufficient upward force. Thus, since a user does not have to touch a latch receiver 110 or a latch inserts 102 to separate them they are referred to herein as self-releasing. Significantly, the matings of the latch inserts 102 into the latch receivers 110 act as downward stops for the frame 21. Please note, the alignment rod mount 30 is not shown in FIG. 6.

The clips formed by the latch receivers 110 are beneficially made of spring steel or another equivalent flexible material. The formed "U"-shaped clips are dimensioned and biased to receive and retain the latch insert 102 by "clipping" onto them. As the frame 21 is lowered the latch inserts 102 enter the latch receivers 110, which biases its formed clip closed around the latch inserts 102.

The preferred embodiment of the present invention can be utilized by the common user in a simple and effortless manner with little or no training. After initial purchase or acquisition of the vertically sliding frame mounting system 10 it would be installed as indicated in FIG. 1.

The method of installing the vertically sliding frame mounting system 10 may be achieved by procuring a model of the vertically sliding frame mounting system 10 having a frame, bracket assemblies 20 and brace assemblies 82 that are suitable for moving and supporting the frame 21 and what it holds in the chosen wall location (avoiding interference with the ceiling and other obstacles); mounting the brace assemblies 82 to the wall using fasteners 90; mounting the bracket assemblies 20 to the frame 21 using fasteners 90; mounting the latch receivers 110 to the wall 100 at a suitable position to defines the lowered position 22 using fasteners 90; inserting the bottoms of the bracket slides 24 of the bracket assemblies into the flared openings 91 of the slide guides 88; sliding the bracket slides 24 downward to be captured by the hooks 84; moving the bracket slides 24 downward to the lowered position 22; determining if the tension of the recoil springs 80 need to be adjusted; if adjustment is required, adjusting the user-adjustable tension mechanisms to achieve the proper adjustment; and finally enjoying the benefits of the vertically sliding frame mounting system.

Should access to the contents of the recessed compartment 105 be desired a user can lift the frame 21 with sufficient force to disengage the self-releasing latches by forcing the latch inserts 102 out of the latch receivers 110; sliding the frame 21 upward to reveal the recessed compartment 105 and thereby gain access to the items 111 within the recessed compartment 105; and then sliding the frame 21 back down to force the latch inserts 102 into the latch receivers 110.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A vertically sliding frame mounting system, comprising:

a frame;

a first bracket assembly attached to said frame;

a second bracket assembly attached to said frame;

a first brace assembly configured to be attached to a wall, said first brace assembly having a first recoil spring, said first recoil spring configured to bias said first bracket assembly upward;

a second brace assembly configured to be attached to said wall, said second brace assembly having a second recoil spring, said second recoil spring configured to bias said second bracket assembly upward;

a first self-releasing latch mechanism having a first latch receiver and a first latch insert, said first latch receiver configured to be attached to said wall, said first latch insert attached to said first bracket assembly; and, a second self-releasing latch mechanism having a second latch receiver and a second latch insert, said second latch receiver configured to be attached to said wall, said second latch insert attached to said second bracket assembly;

wherein said first bracket assembly is slidably disposed in said first brace assembly;

wherein said second bracket assembly is slidably disposed in said second brace assembly;

wherein said first and second self-releasing latch mechanisms are configured to secure said frame in a lowered position when said first and second latch inserts are received in said first and second latch receivers, respectively;

wherein said frame is configured to be lifted by said first and second recoil springs when said first and second latch inserts are released from said first and second latch receivers, respectively;

wherein said first bracket assembly includes a first bracket slide and a first alignment rod, said first alignment rod extending downwardly from said first bracket slide and axially aligned with said first bracket slide;

wherein said first bracket assembly includes a first upper tab, said first upper tab extending upwardly from said first bracket slide and above said first bracket slide, said first upper tab connecting said first bracket assembly to said frame; and wherein said first bracket slide includes a first alignment rod mount, said first alignment rod mount extending downwardly from said first alignment rod and below said first alignment rod, said first alignment rod mount connecting a bottom portion of said first alignment rod to said frame.

2. The vertically sliding frame mounting system according to claim 1, wherein said frame is adapted to hold a mirror.

3. The vertically sliding frame mounting system according to claim 1, wherein said first recoil spring includes a first tension adjustment mechanism.

4. The vertically sliding frame mounting system according to claim 3, further including a first cable wound on said first recoil spring.

5. The vertically sliding frame mounting system according to claim 4, wherein said first cable is connected to a hook abutting said first bracket assembly, said first recoil spring engaging said first bracket assembly via said hook.

6. The vertically sliding frame mounting system according to claim 4, wherein said first and second recoil springs together are strong enough to lift said first and second bracket assemblies and said frame when said first and second latch inserts are released from said first and second latch receivers, respectively.

7. The vertically sliding frame mounting system according to claim 6, wherein said first and second recoil springs are not strong enough together to lift said first and second bracket assemblies and said frame away from said first and second latch receivers when said first and second latch inserts are received in said first and second latch receivers, respectively.

8. The vertically sliding frame mounting system according to claim 1, wherein said first bracket assembly and said second bracket assembly are identical.

9. The vertically sliding frame mounting system according to claim 1, wherein said first bracket slide extends below a midpoint between a top edge of said frame and a bottom edge of said frame.

10. The vertically sliding frame mounting system according to claim 1, wherein said first brace assembly and said second brace assembly are mirror images of one another.

11. The vertically sliding frame mounting system according to claim 1, wherein said first brace assembly includes a first slide guide, said first slide guide receiving said first slide bracket.

12. The vertically sliding frame mounting system according to claim 11, wherein said first slide guide has a top flared opening.

13. The vertically sliding frame mounting system according to claim 1, wherein said first latch receiver forms a latch clip, said latch clip configured to engage said first latch insert.

14. The vertically sliding frame mounting system according to claim 13, wherein said first latch insert, said first bracket assembly, and said first brace assembly are arranged such that lowering said frame causes said first latch insert to enter said first latch receiver.

* * * * *